US007082874B2

(12) United States Patent
Konrad

(10) Patent No.: US 7,082,874 B2
(45) Date of Patent: Aug. 1, 2006

(54) SHORT INKING UNIT

(75) Inventor: Robert Konrad, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 82 days.

(21) Appl. No.: 11/009,729

(22) Filed: Dec. 10, 2004

(65) Prior Publication Data

US 2005/0139105 A1 Jun. 30, 2005

(30) Foreign Application Priority Data

Dec. 12, 2003 (DE) ..... 103 58 232

(51) Int. Cl.
*B41F 31/00* (2006.01)
*B41F 31/14* (2006.01)

(52) U.S. Cl. ..... 101/350.1; 101/352.13; 101/350.6; 101/349.1; 101/153

(58) Field of Classification Search ..... 101/352.13, 101/352.11, 350.1, 349.1, 350.3, 352.06, 101/153, 350.6
See application file for complete search history.

(56) References Cited

U.S. PATENT DOCUMENTS 4,445,432 A * 5/1984 Ford et al. ..... 101/152
4,516,496 A * 5/1985 Giori ..... 101/152
5,282,417 A * 2/1994 Germann ..... 101/152
6,098,546 A * 8/2000 Schell ..... 101/492
2002/0014171 A1* 2/2002 Konrad et al. ..... 101/350.1
2002/0152902 A1* 10/2002 Schwitzky ..... 101/153

* cited by examiner

*Primary Examiner*—Andrew H. Hirshfeld
*Assistant Examiner*—Leo T. Hinze
(74) *Attorney, Agent, or Firm*—Leydig, Voit & Mayer, Ltd.

(57) ABSTRACT

A short inking unit for a planographic printing unit that has a compact design and is operable for transferring an ink film to a form cylinder with high uniformity and stability. This short inking unit includes an applicator roll arrangement having a plurality of applicator rolls (5, 6; 5, 6, 15) which each interact with the form cylinder (1) and are offset with respect to one another in the direction of rotation of said form cylinder (1), and a plurality of engraved rolls (7, 8; 7, 8, 13; 17, 7, 8; 17, 7) which are offset with respect to one another in the direction of rotation of the form cylinder (1) and which each have a respective ink supply for applying ink to the engraved roll. The applicator rolls and engraved rolls form a roll train having rolls which roll on one another in pairs with each pair of rolls including one applicator roll (5, 6, 15) and one engraved roll (7, 8, 13, 17) interacting at a roll nip of the roll train. The rolls of said roll train each are smaller in diameter than the diameter of said form cylinder 1, and the roll train has at least one end formed by an engraved roll which interacts with only one applicator roll.

21 Claims, 4 Drawing Sheets

SHORT INKING UNIT

FIELD OF THE INVENTION

The present invention relates generally to short inking units for planographic printing presses, and particularly, to offset printing presses. More particularly, the invention relates to short inking units having an applicator roll arrangement which interacts with a form cylinder and an engraved roll arrangement with each engraved roll having a respective ink supply.

BACKGROUND OF THE INVENTION

In known short inking units of the foregoing type, the applicator rolls have a diameter which corresponds to the diameter of the form cylinder. Although what are referred to as ghost images are avoided on the printing material as a result of the uniformity of diameters, applicator rolls that are the same size as the form cylinder require a large amount of space which is usually very scarce in printing presses. For this reason, known short inking units usually comprise only one applicator roll. It is not possible in that case to use a plurality of applicator rolls due to the space constraints. Because of the large diameter of the applicator roll, there also is a large amount of ink in the inking unit of such known arrangements. As a consequence, it takes a relatively long time until a constant ink/dampening solution emulsion is attained. Moreover, since there is only one applicator roll there is a very low number of nip points, which also makes it difficult to form a constant ink/dampening solution emulsion. A further disadvantage of the known arrangements is that changing the format is made difficult because the diameter of the applicator rolls is tied to the diameter of the form cylinder. Furthermore, applicator rolls of the same size as the form cylinder require very hard roll coverings which are expensive.

OBJECTS OF THE INVENTION

It is an object of the present invention to provide a short inking unit of the foregoing type which has a compact design but yet effects quality printing.

Another object is to provide a short inking unit as characterized above which is relatively simple in design and inexpensive to manufacture.

According to the invention, an inking unit is provided that has a plurality of applicator rolls which interact with the form cylinder and are offset with respect to one another in the rotational direction of the said form cylinder, and an engraved-roll arrangement is provided that has a plurality of engraved rolls which are offset with respect to one another in the rotational direction of the form cylinder and form a roll train together with the applicator rolls having rolls which roll on one another in pairs and each define a roll nip, with all the rolls of the roll train having a comparatively small diameter in relation to the diameter of the form cylinder, and in each case one engraved roll and one applicator roll interacting at each roll nip of the roll train, and at least one end of the roll train being formed by an engraved roll which interacts with only one applicator roll.

These features advantageously result in a very compact design of the inking unit irrespective of the diameter of the form cylinder, which permits universal use irrespective of the format. On account of the larger number of applicator rolls, not only are ghost images avoided, but high uniformity of the ink film on the printing material is attained, which ensures good printing quality. The large number of applicator rolls and engraved rolls also advantageously leads to a large number of nip points, which permits the formation of a more stable ink/dampening solution emulsion. Since the diameter of the applicator rolls and the engraved rolls can be relatively small in relation to the diameter of the form cylinder, the amount of ink stored in the inking unit also is comparatively small with the result that the desired constant conditions can be attained very rapidly. Moreover, this can have an advantageous effect on the ink consumption. Since the applicator rolls have a comparatively small diameter they can have a standard covering, such as is also used with long inking units, which again reduces production costs. Hence, it can be seen that the invention is achieved in a highly simple and inexpensive manner.

The roll train can have an equal number of engraved rolls and applicator rolls, one end of the roll train being formed by an engraved roll and the other end being formed by an applicator roll. The result of this again is a particularly compact and inexpensive design.

The engraved rolls preferably can be offset relative to the applicator rolls in such a way that the front of the roll train as seen in the rotational direction of the form cylinder is formed by an engraved roll. As a result, good printing quality can be attained using particularly simple and compact means.

The last applicator roll, which is the forward most as seen in the rotational direction of the form cylinder, of the applicator-roll arrangement can be provided with at least one rider roll which interacts with its circumferential region, which is rolled on by the form cylinder, and can preferably be driven in an oscillating manner. This arrangement is particularly effective in avoiding ghosting.

For further suppressing ghosting, the scooping or rub receiving volume of the engraved rolls can be made different. Preferably the rearmost engraved roll as seen in the rotational direction of the form cylinder has the greatest scooping volume, and the scooping volume of each forwardly arranged engraved roll can be progressively smaller.

The fineness of the engraving of the engraved rolls also preferably can be made to increase as the scooping volume decreases, as a result of which moiré formations are advantageously prevented.

A further advantageous feature is that since the diameter of the engraved rolls is different from the diameter of the applicator rolls, it is possible for the engraved rolls all to have identical diameters and for the applicator rolls to have identical diameters. The result of this arrangement is a particularly simple and inexpensive design with many standard components. In every case, however, the diameter of the inking-unit rolls is substantially smaller than that of the form cylinder.

Other objects and advantages of the invention will become apparent upon reading the following detailed description and upon reference to the drawings, in which:

Figure 1:
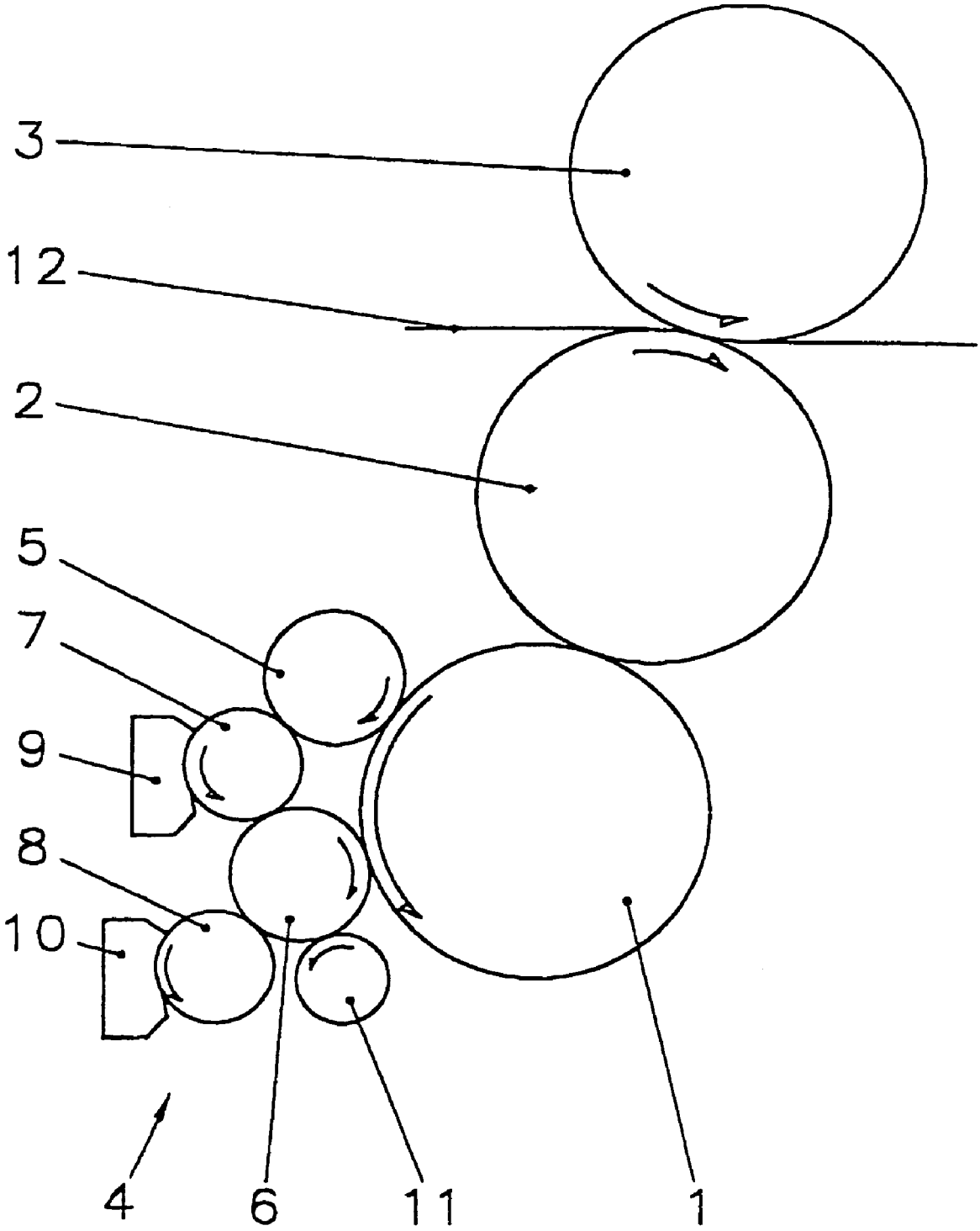
FIG. 1 is a diagrammatic depiction of a printing unit having an inking unit in accordance with the invention, which includes two applicator rolls and two engraved rolls.

While the invention is susceptible of various modifications and alternative constructions, certain illustrated embodiments thereof have been shown in the drawings and will be described below in detail. It should be understood, however, that there is not intention to limit the invention to the specific forms disclosed, but on the contrary, the intention is to cover all modifications, alternative constructions and equivalents falling within the spirit and scope of the invention.

It will further be understood by one skilled in the art that the present invention is primarily directed to planographic printing units for indirect or direct planographic printing with offset printing units for indirect or direct offset printing. Since the basic design and method of operation of such printing units is known in the art, the illustrated printing machine has been diagrammatically depicted and known aspects of the machine need not be described in detail.

DETAILED DESCRIPTION OF PREFERRED EMBODIMENT

Referring now more particularly to the drawings, there is shown a planographic printing machine which includes a form cylinder 1, a transfer cylinder 2, and an impression cylinder 3. A printing material web 12 is passed between the transfer cylinder 2 and the impression cylinder 3. An inking unit 4 is provided to supply ink to the form cylinder 1 for application to the printing material web 12. It will be understood that an appropriate dampening unit also may be provided for applying a dampening solution to the form cylinder when appropriate.

Figure 2:
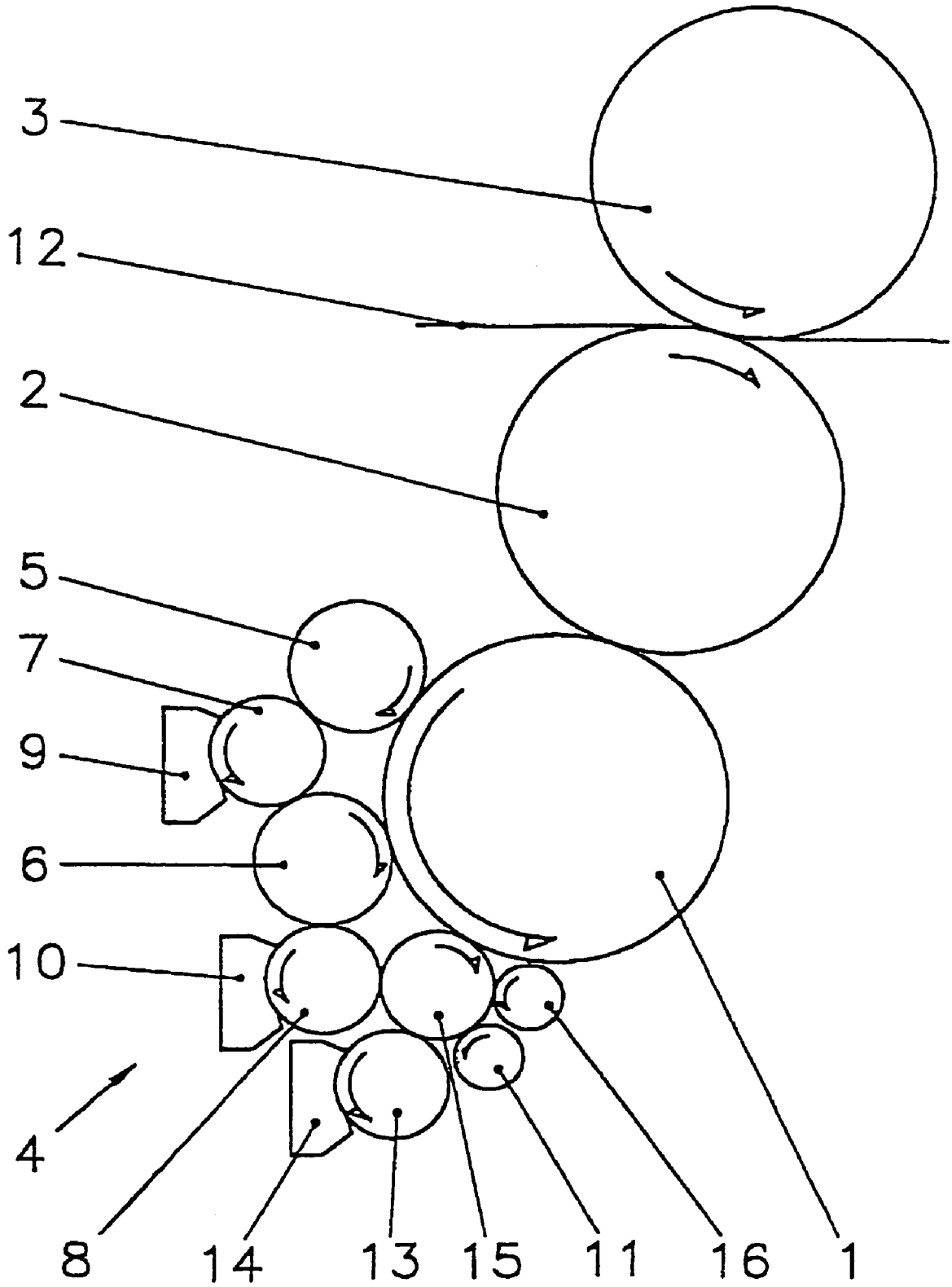
FIG. 2 is a diagrammatic depiction of a printing machine having an alternative embodiment of inking unit in accordance with the invention, which in this case includes three applicator rolls and three engraved rolls.

In accordance with the invention, the inking unit 4 is configured as a short inking unit, comprising a plurality of applicator rolls 5, 6 which interact with the form cylinder 1 and are offset with respect to one another in the rotational direction of the said form cylinder 1, and a plurality of engraved rolls which are assigned to the said applicator rolls are offset with respect to one another in the rotational direction of the form cylinder 1 and form a roll train together with the applicator rolls having in each case rolls which roll on one another in pairs and delimit a roll nip. An engraved roll and an applicator roll interact in each case at every roll nip in the roll train. In each case at least one end of the roll train is formed by an engraved roll. Both the applicator rolls and the engraved rolls have a comparatively small diameter in relation to the diameter of the form cylinder 1. In the embodiment of FIG. 1, two applicator rolls 5, 6 and two engraved rolls 7, 8 are provided. In the embodiment of FIG. 2, three applicator rolls 5, 6, 15 and three engraved rolls 7, 8, 13 are provided. In every case the applicator rolls have a substantially smaller diameter in relation to the diameter of the form cylinder 1. In this instance, the diameter of the applicator rolls is at most one third the diameter of the form cylinder 1. The plurality of applicator rolls can have the same diameter or be different. In the embodiment of FIG. 1, the applicator rolls 5, 6 each have the same diameter which is ⅓ of the diamete4 of the form cylinder. In the embodiment of FIG. 2, the diameter of the applicator roll 15 is smaller than the diameter of the applicator rolls 5, 6 which correspond to the applicator rolls of the first embodiment.

The engraved rolls can likewise have the same diameter or different diameters. In the illustrated embodiments the engraved rolls 7, 8 or 7, 8, 13 each have the same diameter which preferably is even small than the diameter of the applicator rolls 5, 6. In the embodiments shown, the diameter of the engraved rolls 7, 8 or 7, 8, 13 is two thirds of the diameter of the applicator rolls 5, 6 which also corresponds to the diameter of the smaller applicator roll 15 in FIG. 2.

The applicator rolls 5, 6 or 5, 6, 15 are provided with a rubber covering on their circumferences, which can be the same, comparatively soft quality as in long inking units, which is inexpensive. The engraved rolls 7, 8 or 7, 8, 13 have circumferential engraving or a cell pattern or the like. This can be produced by the action of a laser beam on a roll body made of ceramic material. The engraved rolls 7, 8 or 7, 8, 13 are driven at the circumferential speed of the form cylinder by means of an appropriate drive in a known manner. The applicator rolls 5, 6 or 5, 6, 15 can be driveless, and instead, driven by friction by the form cylinder 1 and the engraved rolls which in each case interact with the latter.

Each engraved roll 7, 8 or 7, 8, 13 in this case is supplied with ink from an ink supply means which is doctored off by means of at least one doctor blade. In the embodiments of FIGS. 1 and 2, the engraved rolls 7, 8 or 7, 8, 13 have a chamber-type doctor 9, 10 or 9, 10, 14, with ink being supplied to the interior of the chamber-type doctor which is delimited by two doctor blades. It will be understood that the engraved rolls could also be provided with a common chamber-type doctor or an ink fountain and a doctor blade, or the like.

In this case, the engraved rolls are staggered with respect to the applicator rolls which are spaced apart from one another and offset with respect to one another in the rotational direction of the form cylinder 1 such that the rear end of the abovementioned roll train as seen in the rotational direction of the form cylinder 1 is formed by an applicator roll and the front end is formed by an engraved roll. In this instance, the first applicator roll 5 of the applicator-roll arrangement, which is the rearmost as seen in the rotational direction of the form cylinder 1, interacts with only one engraved roll, in this case with the rear engraved roll 7 as seen in the rotational direction of the form cylinder 1. Each applicator roll which is arranged in front of the first applicator roll 5, that is to say the applicator roll 6 in FIG. 1 and the applicator rolls 6, 15 in FIG. 2, interacts simultaneously with the engraved roll, which also acts with the respective applicator roll arranged in front, and a further engraved roll which is arranged behind it.

Accordingly, the first engraved roll 7 of the engraved-roll arrangement, which is the rearmost as seen in the rotational direction of the form cylinder 1, is in contact here with the first applicator roll 5, which is the rearmost as seen in the rotational direction of the form cylinder 1, of the applicator-roll arrangement and with the second applicator roll 6 which is adjacent to the said first applicator roll 5. The second engraved roll 8 is in contact with the second and third applicator rolls, etc. The last engraved roll of the engraved-roll arrangement is in contact only with the last applicator roll. In the example shown in FIG. 1, this arrangement is limited to two applicator rolls 5, 6 and two engraved rolls 7, 8, the rearmost, engraved roll 7 being arranged between the two applicator rolls 5, 6 and in contact with both applicator rolls 5, 6, and the second, front engraved roll 8 being in contact only with the second, front applicator roll 6. In the embodiment according to FIG. 2, the engraved roll 13 is the forwardmost engraved roll which only makes contact with one applicator roll, here the applicator roll 15, while the two engraved rolls 7, 8 which are arranged in front of it each make contact with two applicator rolls.

At least one rider roll is assigned to the last applicator roll, which is the front one as seen in the rotational direction of the form cylinder 1, of the applicator-roll arrangement. In the embodiment of FIG. 1, only one rider roll 11 is provided. In the embodiment of FIG. 2, a plurality of rider rolls 1, 16 are provided. Each rider roll interacts with that circumferential region of the forwardmost applicator roll 6 or 15 which is rolled on by the form cylinder 1 and returns part of the ink. At least one rider roll, for example the rider roll 11, can be preferably driven in an oscillating manner, that is to say back and forth in the axial direction, by means of an appropriate drive of a known type.

The scooping or ink receiving volume of the engraved rolls 7, 8 or 7, 8, 13 which are offset with respect to one another in the rotational direction of the form cylinder 1 can be identical. Alternatively the scooping volume of the engraved rolls can be precisely designed to decrease towards the foremost engraved roll 8 or 13 as seen in the rotational direction of the form cylinder 1. Accordingly, the engraved roll with the lowest scooping volume is in each case the forwardmost engraved roll. The engraved roll with the greatest scooping volume is in each case the rearmost engraved roll 7 of the engraved-roll arrangement. The scooping volume of any engraved rolls lying between them lies between these volumes. The fineness of the engraving of the engraved rolls 7, 8 or 7, 8, 13 can increase conversely to the scooping volume. Accordingly, the foremost engraved roll 8 or 13 which has the lowest scooping volume has the finest engraving, and the rear engraved roll 7 which has the greatest scooping volume has the coarsest engraving. It is possible to avoid what are known as moiré formations by way of the different scooping volumes and the different engraving finenesses.

Figure 3:
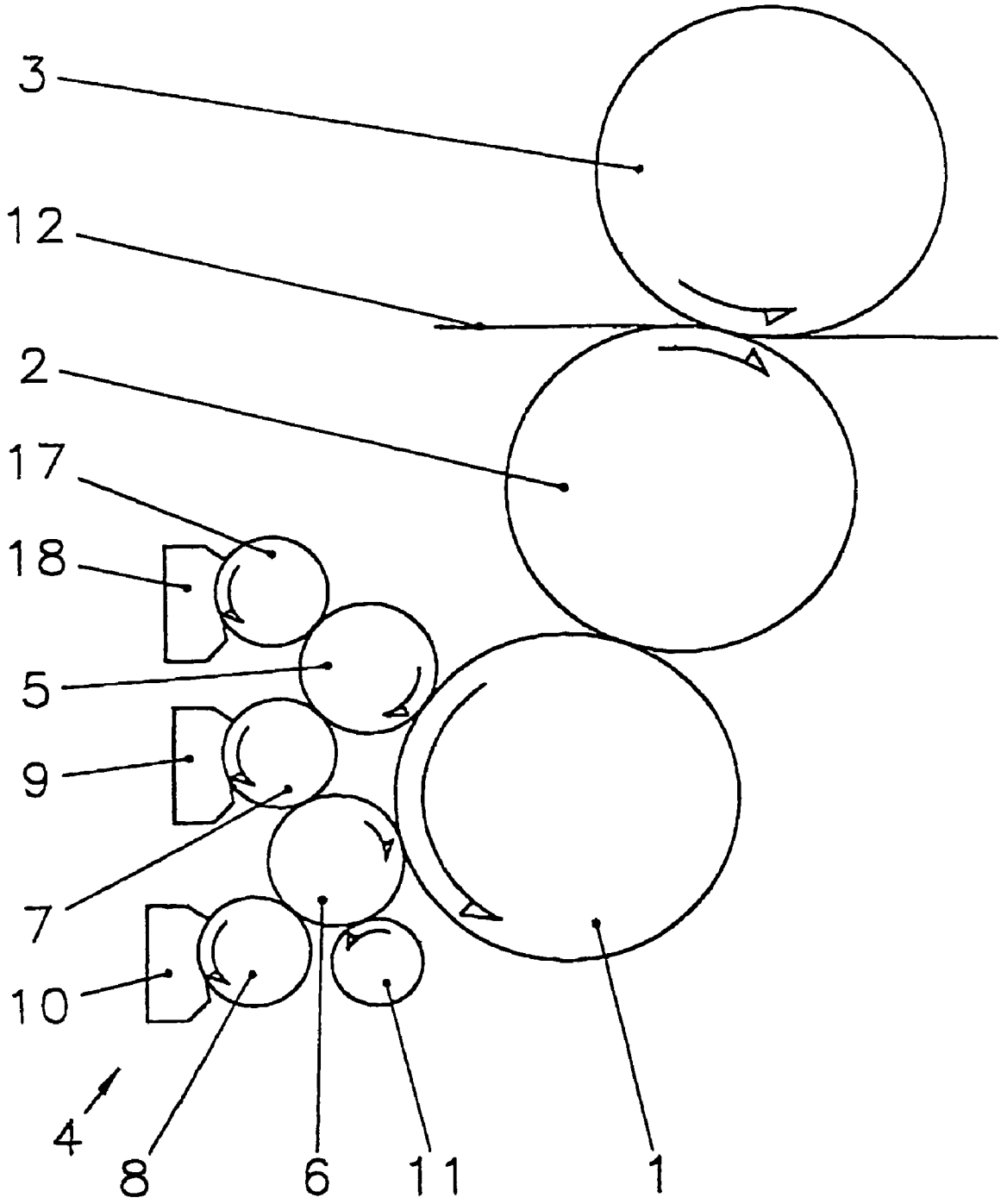
FIG. 3 is a diagrammatic depiction of a printing machine having still a further alternative embodiment of inking unit, which includes an additional engraved roll at the end of the roll train.
Figure 4:
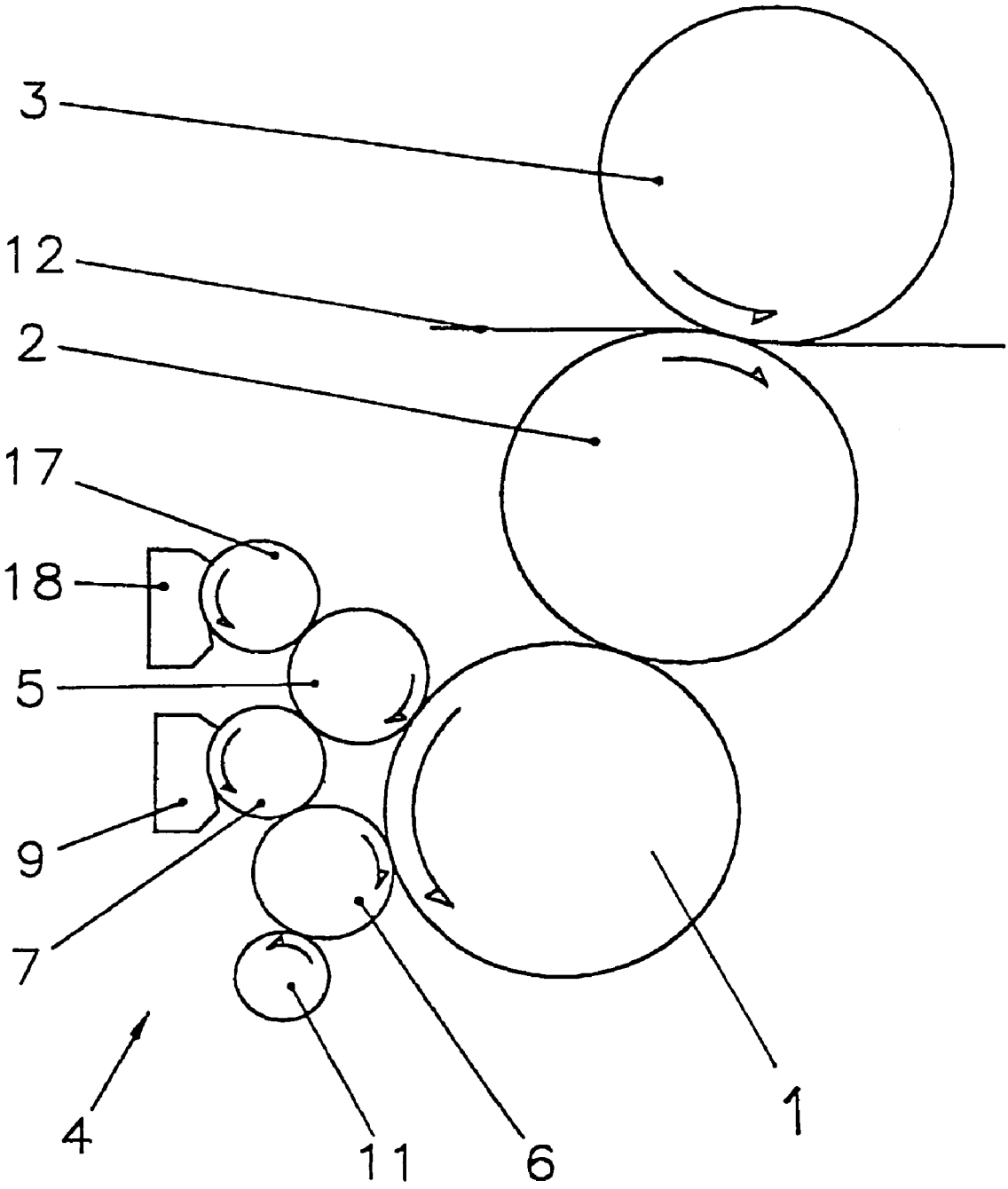
FIG. 4 is a diagrammatic depiction of a printing machine with still a further alternative embodiment of inking unit.

The basic design of the alternative embodiments of inking units shown in FIGS. 3 and 4 correspond closely to the arrangement of FIG. 1. In the following description, similar items have been given similar reference numerals as described previously.

The embodiment of FIG. 3 differs from the arrangement of FIG. 1 only in that the rear applicator roll 5 as seen in the rotational direction of the form cylinder 1 is assigned a further engraved roll 7 which in this case forms the rear end of the roll train as seen in the rotational direction of the form cylinder 1. The engraved roll 17 is provided with a chamber-type doctor 18. In this embodiment, the number of engraved rolls is one larger than the number of applicator rolls, with the result that an engraved roll is provided at both ends of the roll train which is formed by engraved rolls and applicator rolls. Although the engraved roll 17, which is the additional one in comparison with FIG. 1, requires a certain amount of additional expenditure, it has the advantage of providing rapid ink supply to the form cylinder 1 when the inking unit is started up. Additionally, the additional engraved roll provides the assurance that ghosting can be reliably avoided even in difficult situations. Therefore, the embodiment of FIG. 3 may be particularly suitable in applications which are susceptible to ghosting.

The embodiment of FIG. 4 is simplified compared to the arrangement of FIG. 3 in that the front engraved roll is omitted, with the result that there are as many engraved rolls as applicator rolls, as in the arrangement of FIG. 1. In the embodiment of FIG. 4, in contrast to the embodiment of FIG. 1, the front end of the roll train is formed by an applicator roll, namely the applicator roll 6, and the rear end of the roll train is formed by an engraved roll, namely the engraved roll 17. The embodiment of FIG. 4 has identical requirements to the embodiment of FIG. 1 in terms of expenditure. In many cases, however, it is desirable to supply a large quantity of ink to the first applicator roll 5, namely rear applicator roll 5 as seen in the rotational direction of the form cylinder, and to even out the colored image, which is transferred from the form cylinder 1 to this applicator roll, by means of a plurality of roll nips. The embodiment of FIG. 4 may be suitable, in particular, for cases of this type.

What is claimed is:

1. A short inking unit for a planographic printing press comprising a rotatable form cylinder (1), an applicator-roll arrangement which interacts with the form cylinder (1), an engraved roll arrangement which interacts with the applicator-roll arrangement, said applicator roll arrangement including a plurality of applicator rolls (5, 6; 5, 6, 15) which each interact with the form cylinder (1) and are offset with respect to one another in the direction of rotation of said form cylinder (1), said engraved roll arrangement including a plurality of engraved rolls (7, 8; 7, 8, 13; 17, 7, 8; 17, 7) which are offset with respect to one another in the direction of rotation of the form cylinder (1) and which each have a respective ink supply for applying ink to the engraved roll, said applicator rolls and engraved rolls forming a roll train having rolls which roll on one another in pairs that each form a roll nip, said pairs of rolls including one applicator roll (5, 6, 15) and one engraved roll (7, 8, 13, 17) interacting at each roll nip of the roll train, said rolls of said roll train each being smaller in diameter than the diameter of said form cylinder 1, and said roll train having at least one end formed by an engraved roll which interacts with only one applicator roll.

2. The short inking unit of claim 1 in which the number of engraved rolls (7, 8, 17) in said roll train exceeds the number of applicator rolls (5, 6) by one, and both ends of the roll train are formed by an engraved roll.

3. The short inking unit of claim 1 in which said roll train has an equal number of engraved rolls (7, 8, 13, 17) and applicator rolls (5, 6, 15), and one end of the roll train is formed by an engraved roll and another end of the roll train is formed by an applicator roll.

4. The short inking unit of claim 3 in which a front end of the roll train as seen in the rotational direction of the form cylinder (1) is formed by an engraved roll (8 or 13).

5. The short inking unit of claim 1 in which the diameter of at least some of the applicator rolls is identical.

6. The short inking unit of claim 5 in which at least two rearward most applicator rolls (5, 6) as seen in the rotational direction of the form cylinder (1) have an identical diameter.

7. The short inking unit of claim 1 in which said roll train includes more than two applicator rolls (5, 6, 15), and a front applicator roll (15) as seen in the rotational direction of the form cylinder (1) preferably has a smaller diameter than the other applicator rolls.

8. The short inking unit of claim 1 in which said roll train includes only two applicator rolls which have an identical diameter.

9. The short inking unit of claim 1 in which the applicator roll with the largest diameter has a diameter that is no more than a third of the diameter of the form cylinder (1).

10. The short inking unit of claim 1 in which said engraved rolls (7, 8, 13, 10) each have a diameter that is smaller than the diameter of the largest diameter applicator rolls (5, 6) in said roll timer.

11. The short inking unit of claim 1 in which the diameter of all the engraved rolls (7, 8, 13, 17) is identical.

12. The short inking unit of claim 1 in which the diameter of said engraved rolls (7, 8, 13, 17) is two thirds of the diameter of the largest diameter of the applicator rolls (5, 6).

13. The short inking unit of claim 1 in which the diameter of the engraved rolls (7, 8, 13, 17) corresponds to the diameter of a front applicator roll (15) as seen in the rotational direction of the form cylinder (1), and said front applicator roll (15) having a smaller diameter than the other applicator rolls (5, 6).

14. The short inking unit of claim 1 in which a last applicator roll (6, or 15), which is at the front applicator roll as seen in the rotational direction of the form cylinder (1), interacts with at least one rider roll (11) on its circumferential region which is rolled on by the form cylinder (1).

15. The short inking unit of claim 14 in which at least one rider roll (11) is drivable in an oscillating manner.

16. The short inking unit of claim 1 in which said engraved rolls (7, 8, 13, 17) have ink receiving surfaces with scooping volumes for receiving a predetermined volume of ink from the ink supply, and the scooping volumes of at least some of said engraved rolls are different from the scooping volume of other of said engraved rolls.

17. The short inking unit of claim 16 in which a first engraved roll (7) of the engraved roll arrangement which is the rearward most engraved roll as seen in the rotational direction of a form cylinder (1) has the greatest scooping volume of said engraved rolls, and the scooping volume of each engraved roll (8) arranged forwardly of said first engraved roll (7) has a smaller scooping volume than the respective engraved roll arranged forwardly of it.

18. The short inking unit of claim 17 in which said engraved rolls have engraving on the surfaces the fineness of which increases as the scooping volume of the engraved rolls decrease.

19. The short inking unit of claim 1 in which said engraved rolls (7, 8) are drivable at the circumferential speed of the form cylinder (1), and the applicator rolls (5, 6) are friction driven.

20. The short inking unit of claim 1 in which said roll train includes two applicator rolls (5, 6) and two engraved rolls (7, 8), both of said applicator rolls (5, 6) interacting with a first of said two engraved rolls (7), and a front applicator roll (6) as seen in the rotational direction of the form cylinder (1) additionally interacting with the other of said two engraved rolls (8).

21. The short inking unit of claim 1 in which each ink supply has at least one ink doctoring blade.

* * * * *